United States Patent [19]

Singleton et al.

[11] Patent Number: 4,460,541

[45] Date of Patent: Jul. 17, 1984

[54] ALUMINUM POWDER METALLURGY

[75] Inventors: Ogle R. Singleton; H. Marvin Edwards, both of Richmond, Va.

[73] Assignee: Reynolds Metals Company, Richmond, Va.

[21] Appl. No.: 478,283

[22] Filed: Mar. 24, 1983

Related U.S. Application Data

[63] Continuation-in-part of Ser. No. 112,631, Jan. 16, 1980, abandoned.

[51] Int. Cl.[3] ..... F16N 15/08

[52] U.S. Cl. ..... 419/42; 419/47; 419/48

[58] Field of Search ..... 419/42, 47, 48

[56] References Cited

U.S. PATENT DOCUMENTS

| | | | |
|---|---|---|---|
| 3,740,215 | 6/1973 | Burk et al. | 419/48 X |
| 3,860,420 | 1/1975 | Nayar | 419/47 X |
| 4,104,061 | 8/1978 | Roberts | 419/48 X |

OTHER PUBLICATIONS

Otto, "Metallurgical Factors Controlling Structure in High Strength Aluminum P/M Products," NTIS AD-/A-030 606 (1976).

Lewis et al., "A Feasibility Study for Development of Structural Aluminum Alloys from Rapidly Solidified Powders for Aerospace Structural Applications," AFML-TR-78-102 (1978).

Goetzel, *Treatis on Powder Metallurgy,* vol. II (1950) pp. 489-501 and 722-741.

*Primary Examiner*—Leland A. Sebastian

*Attorney, Agent, or Firm*—Alan T. McDonald

[57] ABSTRACT

A process for making a workpiece suitable for being hot worked to produce a wrought metal poduct is described. Aluminum alloy powder is cold compacted and then heated in an inert environment to provide a sinter-sealed shape. The resultant workpiece may then be subjected to conventional processing to produce the desired wrought product.

12 Claims, No Drawings

ALUMINUM POWDER METALLURGY

CROSS REFERENCE TO RELATED APPLICATIONS

This is a continuation-in-part of U.S. application Ser. No. 112,631, filed Jan. 16, 1980 now abandoned.

FIELD OF THE INVENTION

This invention relates in general to the powder metallurgy of aluminum. In particular, it concerns aluminum alloy wrought products and their manufacture involving the use of powdered starting materials.

INVENTION BACKGROUND

In recent years, powder metallurgy has been gaining increasing attention in efforts to obtain new microstructures and improved mechanical properties in alloys of aluminum.

It is well known that aluminum alloys are greatly affected by the rate at which they are quenched from the melt. Faster quenches usually result in smaller grain sizes, increased solid solubility of most solute elements, and reduced segregation of intermetallic phases. In terms of properties, this can mean higher strength at normal and elevated temperatures, higher modulus values, better fracture toughness, lower fatigue crack growth rates, and more resistance to stress corrosion cracking.

Compared with the ordinary methods of ingot casting, powder making enables quenches which are extremely fast. It has been reported that aluminum powders (particulates) have been quenched from the melt at rates on the order of $10^2$ to $10^{8°}$ K./sec, for example.

Thus, powder metallurgy has been seen as offering a new degree of freedom for the development and improvement of new and existing aluminum alloy systems.

In adapting powder metallurgy to the manufacture of wrought products, the idea has been one of consolidating a rapidly-quenched powder to form a basic workpiece which often corresponds to the usual ingot or billet. Ideally, the workpiece can then be hot worked according to conventional methods to produce the desired wrought mill product, such as an extrusion or sheet.

To produce a workpiece of suitable quality, it has been recognized that the powder should be consolidated in a closely controlled manner. Care is needed, for example, to minimize internal workpiece contamination by oxidation, hydration or other reactions with extraneous elements or compounds. Further, in the known art of processing aluminum powder alloys is the stringent care that has been exercised, such as pressing to 140 MPa at about 780° K., in order to minimize internal workpiece porosities, particularly porosities which trap gases at any significant pressure.

A problem which is unique to aluminum powder metallurgy is the inevitable formation of oxides on the powder. These oxides form as thin films, on the order of several nanometers in thickness, on the surfaces of the individual particles. Unlike the oxides which form on other metals used in powder metallurgy, such as copper, iron and their alloys, the oxide film on aluminum or magnesium cannot be reduced to metal insitu. The oxide film on aluminum and its alloys consists almost exclusively of aluminum and magnesium oxides and their compounds or hydrates. These aluminum or magnesium oxide films inhibit the particle-to-particle bonding necessary in forming both good compacts and final products of acceptable ductility and toughness as well as strength. Thus, the formation of aluminum powder products is far more difficult and technically completely distinct from the powder metallurgy of metals with reducible oxides, such as copper, iron and their alloys.

According to a common prior art practice, consolidation of aluminum powders is carried out in the following manner. First, a porous compact is formed by cold isostatic pressing the powder to about 70% of the theoretical density of the alloy being used. Then the compact is machined and encapsulated in a closely fitting aluminum alloy container or can. For degassing purposes, air is then evacuated from the can and the compact is heated to about 520° C. for about 6 to 7 hours in a vacuum of about 6 to 35 microns pressure. While this temperature and vacuum continue to be maintained inside the can, the canned compact is sealed and then compressed to full density at pressures above about 140 MPa. (620 MPa is generally used.) The compact is then cooled and the container is machined away to expose uncontaminated but fully consolidated billet. The billet is then heated and extruded in a conventional manner to produce a wrought product or is otherwise hot worked as by forging.

Variations of this practice are disclosed in U.S. Pat. No. 4,104,061 to S. G. Roberts. During heat-up of the compact for degassing, the container may be evacuated by vacuum, back filled with a depurative gas such as dry nitrogen, and again vacuum evacuated to facilitate the overall degassing process. In addition, the powder can be packed directly into the container, whereby the initial step of cold forming a compact is simply omitted. The hot consolidating step cannot be omitted.

Thus, in the foregoing practice and variations thereof, the use and removal of an aluminum alloy container are seen as essential and costly steps.

It has also been known to place aluminum alloy powder in a vacuum hot press, degass the powder as placed in the press, and then compact the powder to a near solid mass. This process is expensive because of the complex equipment used. Degassing is ofttimes difficult since usually only one end of the powder column is exposed to the vacuum. In vacuum hot pressing the intent is to hot press to 100% density; the result usually is a product of density 96% or more of theoretical.

It was against this background that the development of the present invention came about.

SUMMARY OF THE INVENTION

This invention concerns powder metallurgy and is aimed at making a workpiece, such as a billet or the like, which is suitable for being hot worked to produce a wrought metal product. In a process of this invention the following sequential steps are involved:

(a) Providing an aluminum alloy in the form of a powder.

To be useful for this invention, the alloy should have a melting range of about 20° K. or more, preferably about 50° K. or more, under Standard Conditions. The alloy alternately may be composed of physical mixtures of alloy powders, the main proportion being aluminum with insolubles alloyed and the other powder(s) being elements or aluminum alloy which are readily soluble in aluminum. A melting range as above of the powders is necessary still. The powder should consist essentially of particles solidified at a rate on the order of about 1000° K./sec or more unless it is a fraction that will become fully molten during processing. Generally, the powder will consist essentially of particles having a Fisher APD of about 25 microns or less, and having a gradation of sizes. Preferably, overly coarse powder particles are eliminated by scalping through about a 30 U.S. Standard (USS) mesh sieve. Basically, the upper size limit is not size dependent, as long as the powder will solidify at or above 1000° K./sec or more. The powder should have a minimum oxide film with minimum hydration. In general, an effective oxide film, using fast neutron activation and BET surface area measurements to calculate the film thickness, should preferably be under 10 nanometers.

(b) Producing a compact by the application of isostatic pressure to the powder.

The compact should have a density which is about 60% or more, preferably about 75% or more, of the theoretical density of the alloy being used, but less than about 85%. The upper limit of density is necessary so that the porosity will be essentially interconnected so that the compact may be hot degassed in vacuum. Preferably, the compact is made by loading and packing the powder into a flexible container and applying hydraulic pressure to the container to achieve the desired compact density. It is also preferred that the powder be de-aired and the compact produced in a vacuum atmosphere, e.g. residual air at a pressure of about 10 torr or less in the mold prior to compaction. If the powder has been produced so as to not require hot degassing (i.e., in a dry [about 230° K. dew point or below] low oxygen environment), then the "de-airing" will suffice and cold compaction should be to a density of about 85% or more to prevent the interconnection of porosity more than about 1 mm deep, as may be indicated by suitable measurement of sample pieces. In such cases it is maybe less expensive to use partially or fully annealed powder rather than "W" temper, which is the normal condition of powder as produced.

(c) Exposing the compact to an atmosphere which is essentially devoid of water and gaseous oxidants of the powder particles.

This atmosphere preferably consists essentially of a vacuum, e.g. residual air at a pressure of about $10^{-1}$ torr or less, but it may alternatively consist essentially of a purging inert gas, e.g. dry nitrogen (dew point of about 230° K. or less), at a pressure preferably of about 1 torr or less. The part should be heated to about 650° K. for degassing of the surface films. If the surface is contaminated with water vapor, a lower temperature soak at about 400° K. should be used to remove water as water, thus preventing surface oxidation due to the reduction of water by metallic ions.

(d) After degassing and while the compact is exposed to the atmosphere mentioned in step (c), further heating the compact such that its exterior surfaces attain temperatures at which about 2 to 20 wt% of the alloy would be liquid under Standard Conditions, volatilizing alloying materials from the liquid surface to form a reduced volatile alloying material surface region of about 0.1 to 1.0 millimeters, thereby raising the solidus temperature of the surface region at an equilibrium point and thus causing resolidification at that point, and then cooling the compact such that its exterior surfaces attain temperatures of about 150° K. or more below the solidus of the alloy, such that the compact becomes sinter-sealed by attaining a Degree of Sealing of about 80% or more.

This sinter-sealing of the compact, which may be only a mere surface phenomenon, seals the compact's exterior surfaces and isolates its internal porosity from subsequent ambient atmosphere exposures. The compact material will become fully densified in the course of the subsequent hot working which produces the desired wrought metal product. Thus, there is no need to further consolidate the sinter-sealed compact by means of a separate step.

Made as described, the sinter-sealed compact is a workpiece which is suitable for being handled, stored and processed to produce a wrought metal product, much as if the workpiece had been conventionally cast. Obviously, some caution in handling the compact to avoid penetration of the seal layer is required.

One advantage of the invention process is that there is no need for using the gas tight encapsulating container of the previously described more common prior art practices. A special advantage is that the encapsulating container does not have to be removed, with its attendant mixed scrap generation. Another advantage is that the process may be conveniently carried out using a conventional, simple vacuum furnace, wherein pressures and temperatures are more easily monitored.

In a preferred practice of the invention, after step (b) the compact is loaded into a vacuum furnace and heated under vacuum to a temperature of first about 375° K. and then about 600° K. and held for degassing at each temperature. Then, with the compact being degassed (step c completed) maintaining the furnace vacuum at a pressure of below 100 microns, step (d) is begun. The compact is heated to the solidus temperature of the alloy (as determined under Standard Conditions), plus about 20° K. to achieve about 10% molten phase under Standard Conditions at least over the entire surface and to a depth of at least about 5 mm. A soak of at least about 5 minutes or of sufficient time to ensure that the entire near surface region is liquated is required. During the heating cycle of this step, a controlled volatilization of volatile alloying materials occurs. This produces a surface region or shell of the compact having a reduced volatile alloying material composition, having a thickness of about 0.1 to 1 millimeters. This region, having a higher percentage of aluminum, has a higher solidus temperature than the original alloy, thus causing the shell to resolidify at an equilibrium point. After cooling in vacuum to the solidus under Standard Conditions minus about 150° K., sufficient to provide strength to the seal layer, the furnace may be back filled with gas, preferably dry nitrogen for more rapid cooling. The resultant sinter-sealed compact can then be further cooled and removed from the vacuum furnace following usual procedures.

For purposes of the invention's description herein, the following terms have special meaning:

"Standard Conditions" means the conditions under which a property of an aluminum alloy is determined while exposing the alloy to an ambient atmosphere at a sea level pressure.

"Degree of Sealing" means the percentage of a compact's total porosity volume which becomes sealed off and prevented from communicating with the outside ambient atmosphere. It can be calculated experimentally as follows. First, the compact specimen is weighed in air. Then, to determine the specimen volume, the specimen is impregnated with a molten wax, such as hydrogenated cotton seed oil, by an overnight soaking under a mechanical pump vacuum. The specimen is then cooled, removed from the solidified wax and then stripped of wax by hand. The impregnated specimen is then weighed, first in air, and then in distilled water of a known temperature. The loss of specimen weight in water divided by the density of the water gives the specimen volume. The Degree of Sealing ("DS") can then be approximated by the following formula:

$$DS = \frac{Vo - Vw}{Vo} \times 100, \text{ where}$$

$$Vw = \frac{Wi - Wo}{Vs \times Pw}, \text{ and}$$

$$Vo = \frac{Pt - Ps}{Pt},$$

the nomenclature being as follows:

Ps=specimen density
Pt=theoretical density of specimen alloy
Pw=density of impregnating wax
Vs=specimen volume
Wo=original specimen weight in air
Wi=weight of specimen in air after impregnation
Vo=total porosity volume per unit specimen volume
Vw=volume of impregnating wax per unit specimen volume Because of surface irregularities a totally sealed specimen would indicate a Degree of Sealing of less than 100% using this method.

EXEMPLARY INVENTION EMBODIMENTS

In general, the aluminum alloys or blends to which this invention's processes are suited are limited only insofar as they are characterized by a melting range of about 20° K. or more, preferably about 50° K. or more, as determined under Standard Conditions. This is so that some surface melting can occur to effect sinter-sealing while at the same time the base alloy matrix can remain solid and self supporting and not destroy the metallurgical structure advantage achieved by rapid solidification.

The alloys that will generally be of interest will contain about 80% or more aluminum by weight, and one or more element from the group consisting of Li, Mg, Ca, Zn, and include one or more elements from the group Cu, Si, Fe, Mn, Ni, Mo, Cr, Zr, V, Ti, B, Be, and may contain Co or Hf.

Of particular interest will be the high strength heat-treatable alloys from the 2000 series, i.e., alloys containing about 2.5 to 6.5% Cu and up to about 2.0 wt% Mg, and from the 7000 series, i.e. alloys containing about 4.0 to 12.0 wt% Zn and about 1.0 to 4.0% Mg. After hot working, these alloys can be conventionally solution heat treated, quenched and artificially or naturally aged to achieve characteristics of high strength and toughness and good resistance to stress corrosion cracking.

Alloys which have attracted considerable attention consist essentially of about 5.0 to 10.0 wt% Zn, about 2.0 to 4.0 wt% Mg, about 1.0 to 2.0 wt% Cu and about 0.2 to 2.0 wt% Co. It has been reported that powder metallurgy has been adapted to such alloys in producing wrought mill products with high toughness and high strength. One example is alloy 7091 which nominally contains 6.5 wt% Zn, 2.5 wt% Mg, 1.5 wt% Cu and 0.4 wt% Co. For use in sinter-seal processing, because of its relatively fast diffusion rate, Co is preferably kept at a minimum level or replaced by other elements which are known to be replacements for the Co function and which have lower diffusion rates in aluminum.

To obtain the advantages that powder metallurgy offers, the powders used should consist essentially of particles which have been quenched from the melt at rates on the order of about 1000° K./sec or more. Nodular irregular powders are ideal if their oxide films are thin and their degree of hydration is minimal.

For the powders to be amenable to sinter-seal processing, they may consist essentially of particles scalped through about 30 USS mesh screen and having preferably a Fisher APD of about 25 microns or less and a gradation of sizes. It is appreciated, however, that particle size characterization of irregular, nodular particles depends to some degree on how the particle size is measured.

The powders may be prealloyed, i.e. where all particles have essentially the same composition. Alternatively, the particles may have varying compositions whereby the powder constitutes a mixture. Where the latter approach is used, highly soluble elements (e.g. Cu, Mg, Zn, Si and Li) may be added elementally, or combined with up to about 90 wt% aluminum, or added as near eutectics e.g. as about 10 to 14 wt% Si, balance Al. To obtain small constituent sizes for intermetallic phases of low solubility, the less soluble elements (e.g. Fe, Mo, Mn, Ni, Cr, Zr, Ti, B, V, Co and Hf) should be combined along with the main portion of aluminum which is the base of the composition of the particular alloy.

Where the mixture approach is used, the composition containing the insoluble elements will be the predominant one, and consequentially is the only composition to which the 1000° K./sec. particle quench rate would necessarily apply.

The mixture approach is deemed useful because by varying compositions it may be possible to increase the solidus temperature of the predominating composition and also not to limit its melting range. Importantly, the mixture technique, by avoiding Al-Mg compositions in the predominant powder, can reduce the degree of detrimental hydration of the powder during storage. The mixture technique can also permit reduction of the temperature to achieve liquid metal flow and sealing which will permit lower temperatures for the sinter-sealing step and thereby make it easier to avoid dispersoid coarsening in the microstructure of the predominating composition. The approach may also be advantageous in that aluminum alloys containing lithium or magnesium are hazardous to air-atomize and it may therefore prove safer and less expensive to add those elements as separate, benefiting compositions. Further, the liquid and vapor of Al-Mg, Al-Li, and Al-Ca have a fluxing action and tend to disrupt surface films on the other particles in the compact (see O. R. Singleton, *Welding Journal,* Nov. 1070, p. 843).

Another variation on powder selection would be to anneal or soften a portion of the prealloyed, naturally age hardenable particles with a view toward improving cold compactability. For present purposes, as produced air-atomized powders are designated as "F" temper. (As a practical manner, "F" temper is typically W 72 hours or more.) Annealed powders are designated as "0" temper. A 7091 air-atomized powder can be annealed, for example, by heating it to 370° to 400° C. in a 175 micron residual air vacuum or in dry nitrogen, and then allowing it to cool in that atmosphere overnight. If clumping occurs, the powder can conveniently be broken up by screening with a 60 mesh screen to restore good powder flow characteristics. A mixture of "F" temper and "0" temper particles gives improved initial bonding due to greater inter-particle contact than with either temper particles alone.

If a compact is desired from an aluminum alloy which does not meet the criteria previously discussed, it is possible to form a composite compact. For example, in one case the powder may be prealloyed and not have sufficient melting range and the criteria meeting powder may be a physical mixture having the same or almost the same composition but composed of sufficient aluminum eutectics to meet the needed criteria. In other cases, the two alloys may be of considerably or completely different compositions. In this procedure, the flexible container has its bottom covered with powder of an aluminum powder meeting the criteria as previously discussed. An open end sleeve is placed within the flexible container over the powder and is filled with the non-criteria meeting alloy materials. Next, criteria-meeting alloy powder is placed around the sleeve, filling in the space between the sleeve and the flexible container, and the sleeve is removed. Finally, criteria-meeting alloy powder is employed to fill the top of the flexible container, thus completing the surrounding of the non-criteria meeting powder. The composite compact is then subjected to the process of the present invention. The finished composite product may be employed as a clad material, or the skin formed from the criteria-meeting alloy powder may be machined away. If the billet is to be clad and the clad retained and the hot working is to be by extrusion, then indirect extrusion has been shown in the art to maximize good product and is thus the preferred process.

As a further aid to understanding the present invention, the following examples are given:

EXAMPLE I

Prealloyed powders of 7091 composition were air atomized from the melt, with melt temperatures being about 750° C. or higher. Representative individual particles were metallographically examined from these powders, and dendrite arm spacings were found to range from about 0.5 to 9 microns. This indicated an average particle quench rate of about $10^{3}$° K./sec or more. For these 7091 powders, silicon content ranged from about 0.03 to 0.05 wt.%, iron content ranged from about 0.02 to 0.09 wt.%, the Fisher APD ranged from about 15 to 19 microns and the average particle modal size range (as determined by L & N's "Microtrac", Sharple's "Micromerograph", and "Micromeritic's Sedigraph") was about 22 to 44 microns equivalent spherical diameter. The constituent size of the important intermetallic $CO_2Al_9$ was generally below 1 micron.

EXAMPLE II

A melt of an alloy consisting essentially of 6.5 wt% Zn and 0.4 wt% Co, balance aluminum, (LSB 229) was atomized and examined as in Example I. This alloy showed essentially the same results for dendrite arm spacing and $Co_2Al_9$ constituent size as for the Example I 7091 alloys. The LSB 229 alloy was then blended with the needed amounts of commercially obtained −325 USS mesh copper and magnesium powders to arrive at a mixture constituting the 7091 composition. For the LSB 229 powder, the Fisher APD was about 17.5 microns; the silicon content was about 0.03 wt%; the iron content was about 0.09 wt%, with other impurities less than about 0.02 wt% each; and the modal size range for the powder was about 22 to 31 microns equivalent spherical diameter by three methods of sizing, L & N's "Microtrac", Sharple's "Micromerograph", and Micromeritic's "Sedigraph".

EXAMPLE III

For this example, the powder mixture of Example II was used. A charge of this mixture was jolt packed in a ⅛" thick, cylindrical, rubber-bag mold held in a perforated cylindrical aluminum support. The rubber mold was closed with a suitable rubber closure and the powder was deaired with a mechanical vacuum pump to an absolute pressure of about 5 torr prior to final sealing of the rubber container. The powder mixture was cold isostatically pressed at about 210 MPa to achieve a calculated density of about 83% of theoretical. The resulting compact was then sintered in a vacuum furnace with a soak at about 555° C. for about 1 hour in residual air at less than $1\times10^{-2}$ torr absolute pressure. The compact was then cooled in vacuum to below 430° C. before exposure to ambient atmosphere. The resultant sinter-sealed compact had an estimated Degree of Sealing of 87%. The compact was then reheated in air to a temperature of about 350° C. and extruded at about 2.4 cm/sec into 1.3 cm diamater rod. The rod was solution heat treated in an air recirculating furnace at about 490° C. and then cold-water quenched. Close visual inspection of the quenched rod revealed no blisters. The rod then was artificially aged for 24 hours at 120° C. plus 8 hours at 155° C. Samples machined from the rod were tested for properties and found to average for three specimens a tensile strength of 617 MPa, a 0.2% offset yield strength of 584 MPa, and an elongation in 2.5 cm of 12% (RA=26%). The electrical conductivity of the rod was about 39% IACS. A metallographic analysis of the rod revealed that the intermetallic constituents were generally below 2 microns in size.

EXAMPLE IV

For this example, air atomized prealloyed CT91 powder of Example I was softened or annealed by thermal treatments at 375° C. and at 230° C. This annealed powder was then cold isostatically pressed in a deaired rubber mold at about 210 MPa to achieve about 85% of theoretical density. The resultant compact was then sintered in a furnace purged with boil off liquid nitrogen gas such that a sample of furnace atmosphere from near the billet was continuously monitored as being −40° C. dew point or lower at furnace temperatures above 300° C. The billet was taken to about 555° C. and held for one hour. (It was estimated that about 2 to 4% of the alloy was molten at this temperature.) The compact was then cooled in the furnace still under purge to below 400° C. prior to exposure to ambient conditions. The resultant sinter-sealed compact, which had an estimated Degree of Sealing of about 85%, was then reheated in air to a temperature of about 330° C. and extruded at about 2 cm/sec into about 1.3 cm diameter rod. This rod was solution heat treated in an air recirculating furnace at 490° C. then cold-water quenched. Close visual inspection of the quenched rod revealed no blisters. The rod was then artificially aged for 24 hours at 120° C. plus 8 hours at 155° C. Samples machined from the rod were tested for properties and found to average for three specimens a tensile strength of 618 MPa, a 0.2% offset yield strength of 578 MPa and an elongation in 2.5 cm of 11.7%. The electrical conductivity was 38.8% IACS.

EXAMPLE V

Prealloyed 7091 powder in "F" temper from Example I was cold isostatically pressed in a deaired rubber container at a pressure of about 280 MPa to an estimated 80% of theoretical density. The resultant compact was then placed in a vacuum furnace and gradually heated to about 320° C. with the furnace being pumped down to less than about $1\times10^{-3}$ torr. This pressure level was maintained within the furnace by continued pumping and the temperature of the compact was raised to the range of about 580° to 600° C. (estimated 12 to 15% molten under Standard Conditions) and held for one hour. The compact was then cooled in vacuum to below 480° C. before exposure to the atmosphere.

The resultant sinter-sealed compact, which had an estimated Degree of Sealing above about 95%, was preheated to about 390° C., put in an extrusion press with a hot chamber and hot upset compacted against a blind die to a pressure of about 900 MPa, whereby about 95% or more of the 7091 theoretical density was achieved. The tooling of the press was quickly changed and the hot compacted workpiece was extruded to about 380° C. into a 1.3 cm diameter rod with an extrusion break pressure of about 600 MPa. The extrusion speed was 2.9 cm/sec. The product rod was solution heat treated in air at 490° C. and then cold°water quenched. Close visual inspection of the rod revealed no blisters. The rod was aged 15 hours at 125° C. plus 8 hours at 165° C. The conductivity of the rod was 37.9% IACS. The mechanical properties of the rod were determined to average 572 MPa tensile strength, 564 MPa yield strength, 10.2% elongation in 4D, a notch tensile strength [notch root radius ¼0.0007" (¼0.01778 mm)] of 713 MPa for a NTS/YS ratio of 1.26. The density of the rod was determined by a precision buoyancy technique to be 2.8335 gm/cc which was considered to be about 100% dense.

A second sinter-sealed compact was made as above and also had an estimated Degree of Sealing of about 95%. This workpiece was preheated to 395° C., put in the same extrusion press, and directly extruded through the same die to produce a 1.3 cm diameter rod with an extrusion break pressure of 690 MPa, which was somewhat higher than the break out pressure of the hot upset billet in the previous paragraph. The rod exhibited a flowered or broken end as contrasted with the solid end of the previous billet; however the broken region extended no more than about two rod diameters. This rod was solution treated, quenched and aged as with the previous rod and also tested in the same manner on the same equipment. The average mechanical properties determined on specimens from the rod were 611 MPa tensile strength, 579 MPa yield strength, 11.3% elongation in 4D, and 735 MPa notch tensile strength for a NTS/YS ratio of 1.27. Electrical conductivity was 38.2% IACS. A precision bouancy measurement gave a product density of 2.8360. This rod showed equivalent strength and toughness and density of that rod produced from the hot upset compact. These last two examples show that although a sinter-sealed billet may be hot upset to or near full density prior to extrusion as a necessary step in the prior art, this expensive step is not required in processing a sinter-sealed billet showing that the sinter-seal process is distinct from the prior art in this important regard as well as in the seal formation step.

Third and fourth compacts were made using a blend of 60% "F" temper Example I powder of over 6 months age and 40% Example I powder softened by thermal treatment in dry nitrogen up to 390° C. This blend was processed to sinter-sealed compacts as above and extruded; one workpiece was first hot upset compacted as above and one was not. The extrusion break out pressure for both rods was about 690 MPa. The strengths, elongations and NTS/YS ratios were not significantly different from the values obtained on the previous two rods, and thus both of the blended powder billets gave fully dense extruded rods of high strength and good toughness as indicated by NTS/YS ratio of 1.25 or more.

EXAMPLE VI

A series of sinter-sealed compacts were prepared from the 7091 alloy air atomized, "F" temper Example I powder. The powder was vibration-packed then jolt-packed in rubber molds, deaired, and cold isostatically pressed at several pressures. The resultant compacts were then degassed and sinter-sealed as given in Table 1 below.

TABLE I

| | | | Billet Production Conditions | | | | | | |
|---|---|---|---|---|---|---|---|---|---|
| | | Estimated | End Degas | | Sinter-seal | | Max | Cool in | Appropriate |
| ID | CIP (MPa) | Density (%) | Pressure (torr) | Temp (°C.) | Temp (°C.) | Time (min.) | Pressure (torr) | Vacuum to (°C.) | Degree of Sealing (%) |
| 81A | 210 | 76 | $<1\times10^{-3}$ | 380 | 565–577 | 60 | $8\times10^{-3}$ | 425 | 90 |
| 79A | 310 | 83 | $<1\times10^{-3}$ | 380 | 565–595 | 60 | $1\times10^{-2}$ | 345 | 95 |
| 83B | 170 | 74 | $3\times10^{-1}$* | 380 | 565–590 | 60 | $2\times10^{-2}$** | 425 | 85 |

*dynamic flush or purge with boil-off liquid nitrogen
**static dry nitrogen at reduced pressure The resultant sinter-sealed workpieces were later reheated in air and extruded at about an 11 to 1 extrusion ratio into approximate 6.6 mm×41.5 mm bars which, unlike the previously extruded rods, permitted determination of long-traverse mechanical properties. The bars were solution heat treated at about 490° C., cold-water quenched and artificially aged by 15½ hrs at 124° C. and 8 hrs at 166° C. There were no blisters on the resultant heat-treated bars.

The extrusion reheat temperature and heat treated mechanical properties in the long transverse direction are given in Table 2.

TABLE 2

| | Extrusion Temperature and Mechanical Properties | | | |
|---|---|---|---|---|
| ID | Reheat Temp. °C. | UTS MPa | YS (0.2%) MPa | Elong % in 4D |
| 81A | 455 | 575 | 529 | 14.5 |
| 79A | 455 | 573 | 525 | 9.8 |

TABLE 2-continued

| Extrusion Temperature and Mechanical Properties | | | | |
|---|---|---|---|---|
| ID | Reheat Temp. °C. | UTS MPa | YS (0.2%) MPa | Elong % in 4D |
| 83B | 400 | 583 | 532 | 12.6 |

To estimate toughness, reduced size Charpy impact longitudinal specimens were tested from heat treated bar 83B and yielded an impact energy of 5.8 and 6.7 joules normalized to standard Charpy size. These values indicate typical toughness expected of this alloy.

EXAMPLE VII

A 2117 type alloy powder mixture was made up as follows:

2.5 wt% −325 USS mesh copper powder;
0.4 wt% −325 USS mesh magnesium powder;
0.4 wt% −200 USS mesh silicon powder;
balance −100 USS mesh air-atomized aluminum powder.

The powder mixture was blended and then loaded into a rectangular rubber mold supported by a perforated metal container on the four sides and the bottom; and the resultant sealed rubber mold was then cold isostatically pressed at about 30 ksi to produce a compact of substantially rectangular cross section and sufficient green strength to be handled in manufacturing-type operations. The compact was then placed in a vacuum furnace and subjected to a mechanically pumped vacuum in the $10^{-3}$, $10^{-2}$ torr pressure range and then heated slowly to about 320° C., holding there until the pressure was again reduced to the $10^{-3}$, $10^{-2}$ torr range. The compact was then further heated under continued pumping to achieve a temperature in the 500° to 550° C. range and a pressure less than about $2\times10^{-2}$ torr. Nitrogen gas boiled from its liquid was then bled into the furnace to about 1 torr pressure, pumping was stopped and the furnace was valved closed. The degassed compact was then heated to 620° to 625° C., held there for about half an hour, then cooled to below about 400° C. before exposure to ambient atmosphere. Degree of Sealing was estimated as about 98%.

The resultant sinter-sealed compact was later reheated to the 450° C. range and hot rolled more than 70% to a line gauge of 0.072" and then cold rolled to 0.040" sheet. The sheet was sampled and the samples were solution heat treated at 495° to 500° C. for 5 minutes, cold water quenched and then naturally aged at room temperature for 14 days. Longitudinal tensile tests gave a tensile strength of 319 MPa average for duplicate specimens, a yield strength of 165 MPa average, and an elongation in 2 inches of 21%. These are typical properties for this wrought alloy in sheet form.

While various exemplary embodiments of the present invention have herein been described, it will be understood that the present invention's scope is to be determined and limited only by the scope of the following claims.

What is claimed is:

1. A process for making a workpiece suitable for being hot worked to produce a wrought metal product, where said process comprises the following sequential steps:

(a) Providing an aluminum alloy characterized by a melting range of about 20° K. or more under Standard Conditions, said alloy being in the form of a powder consisting essentially of particles solidified at a rate on the order of about 1000° K./sec or more;

(b) Producing a compact by the application of isostatic pressure to said powder, such that the density of said compact is about 60% to 85% of the theoretical density of said alloy;

(c) Exposing said compact to a dynamic atmosphere which is essentially devoid of water and gaseous oxidants of said alloy and heating the composite to a temperature of up to about 650° K. to degas the surface films and to preferably remove $H_2O$ as $H_2O$;

(d) While said compact is exposed to said atmosphere, further heating said compact such that its exterior surfaces attain temperatures at which about 2 to 20 wt% of said alloy would be liquid under Standard Conditions, volatilizing alloying materials from a liquid surface region to form a reduced volatile alloying material surface region of about 0.1 to 1 millimeters, thereby raising the solidus temperature of said surface region at an equilibrium point causing resolidification of said surface region at said equilibrium point, and then cooling said compact such that its exterior surfaces attain temperatures of about 150° K. or more below the solidus of said alloy, such that said compact becomes sinter-sealed by attaining a Degree of Sealing of about 80% or more.

2. A process according to claim 1 wherein following step (d), said compact is hot worked to produce a wrought metal product which has about the same density as the theoretical density of said alloy.

3. A process according to claim 1 wherein step (b) is carried out by producing said compact in a vacuum atmosphere which consists essentially of residual air at a pressure of about 10 torr or less.

4. A process according to claim 1 wherein for purposes of steps (c) and (d) said atmosphere consists essentially of a dynamic vacuum at a pressure of about $10^{-1}$ torr or less.

5. A process according to claim 1 wherein for purposes of step (c), said atmosphere consists essentially of a dynamic inert gas atmosphere at a pressure of less than $10^{-1}$ torr and step (d) is an inert atmosphere of about 1 torr or less pressure.

6. A process according to claim 1 wherein following step (b), said compact is loaded into a vacuum furnace and then heated under vacuum to a temperature of about 300° C., followed by carrying out step (d).

7. A process according to claim 1 wherein step (b) is carried out by loading and packing said powder into a flexible container, having the pressure of air in said container reduced to about 10 torr or less, sealing the container under vacuum and applying hydraulic pressure to said container such that the density of said compact is about 75% to 85% of the theoretical density of said alloy.

8. A process according to claim 1 wherein said powder consists essentially of particles scalped through about 30 USS mesh screen and having a Fisher APD of about 25 microns, and a gradation of sizes.

9. A process according to claim 1 wherein said powder consists essentially of F temper particles each having the composition of said alloy.

10. A process according to claim 1 wherein said alloy consists essentially of about 80% or more Al, by weight, and one or more elements selected from the group consisting of Mg, Zn, Ca, and Li, and at least one or more elements from the group consisting of Fe, Cu, Mn, Si, Mo, Cr, Ni, Zr, Ti, V, B, Co and Hf.

11. A process according to claim 10 wherein said powder consists essentially of particles having varying compositions whereby said powder constitutes a mixture; there being for at least one constituent element X of said alloy, where X is from the group consisting of Cu, Mg, Ca, Zn, Si and Li, a separate composition consisting essentially of about 10 to 100 wt% X, balance aluminum; and there being a single separate composition which comprises the predominant amount of aluminum needed together with all of the constituent elements of said alloy which are from the group consisting of Fe, Mn, Mo, Ca, Cr, Zr, Ni, Y, Ti, B, Co and Hf.

12. A process according to claim 1 wherein said loading comprises a filling of the bottom of said flexible container with a first alloy, placing a sleeve within said flexible container, filling said sleeve with a second alloy, filling spaces between said sleeve and said flexible container with said first alloy, removing said sleeve and filling the top of said flexible container with said first alloy.

* * * * *